US007401950B2

(12) United States Patent
Larouche

(10) Patent No.: US 7,401,950 B2
(45) Date of Patent: Jul. 22, 2008

(54) ASSEMBLY FOR VERTICALLY POSITIONING A LAMP-SHADE

(75) Inventor: Michael Larouche, Quebec (CA)

(73) Assignee: Eclairage Contraste, Quebec (CA)

( * ) Notice: Subject to any disclaimer, the term of this patent is extended or adjusted under 35 U.S.C. 154(b) by 266 days.

(21) Appl. No.: 11/365,661

(22) Filed: Mar. 2, 2006

(65) Prior Publication Data

US 2007/0147050 A1 Jun. 28, 2007

(30) Foreign Application Priority Data

Dec. 22, 2005 (CA) ..... 2531464

(51) Int. Cl.
*F21S 8/02* (2006.01)
*F21V 21/00* (2006.01)

(52) U.S. Cl. ..... 362/391; 362/147; 362/285; 362/404

(58) Field of Classification Search ..... 362/147, 362/285, 391, 404
See application file for complete search history.

(56) References Cited

U.S. PATENT DOCUMENTS 4,821,162 A * 4/1989 Ellis ..... 362/408
5,158,360 A * 10/1992 Banke ..... 362/391
6,536,925 B1 * 3/2003 McGuire ..... 362/391

* cited by examiner

*Primary Examiner*—Sandra O'Shea
*Assistant Examiner*—James W Cranson
(74) *Attorney, Agent, or Firm*—Nixon & Vanderhye PC

(57) ABSTRACT

An assembly for vertically positioning a lamp-shade suspended by a cable comprises a socket member, a swivel cap adapted to engage the upper end of the socket member. The swivel cap has an off-center hole to receive the cable therethrough, the cap being adapted to be swivelled until the socket member has reached a vertical position. The assembly also includes an element for securing the cap and the socket member to one another when a vertical position is reached.

5 Claims, 3 Drawing Sheets

ASSEMBLY FOR VERTICALLY POSITIONING A LAMP-SHADE

CROSS REFERENCE TO RELATED APPLICATIONS

This application claims priority on Canadian pending application No. 2,531,464 filed on Dec. 22, 2005. The document above is herein incorporated by reference.

FIELD OF THE INVENTION

The present invention pertains to an assembly for vertically positioning a lamp-shade which is suspended by a cable having a lamp socket fixed at one end thereof.

BACKGROUND OF THE INVENTION

Whenever fixedly installing a suspended lamp-shade from a ceiling, it often occurs that the lamp-shade is not vertically positioned or, in other words, the axis of the lamp-shade is not coincident with the axis of the cable suspending the lamp-shade.

OBJECTS AND STATEMENT OF THE INVENTION

It is an object of the present invention to provide an assembly which will enable a lamp-shade to be vertically positioned or have its vertical axis parallel or coincident with the vertical axis of the suspending cable.

This is achieved by providing an assembly which comprises:

a socket member having an open lower end for receiving the socket therein and an opened upper end;

a swivel cap adapted to engage the upper open end of the member; the swivel cap having an off-center hole to receive therethrough the cable; the cap being manually swivelable until the socket member has reached a vertical position; and means for securing the cap and the socket member to one another when the vertical position is reached.

In one form of the invention, the securing means consists of a set screw that extends through the cap and has one end contacting an upper face of the socket member.

Other objects and further scope of applicability of the present invention will become apparent from the detailed description given hereinafter. It should be understood, however, that this detailed description, while indicating preferred embodiments of the invention, is given by way of illustration only, since various changes and modifications within the spirit and scope of the invention will become apparent to those skilled in the art.

DESCRIPTION OF EMBODIMENTS OF THE INVENTION

Figure 1:
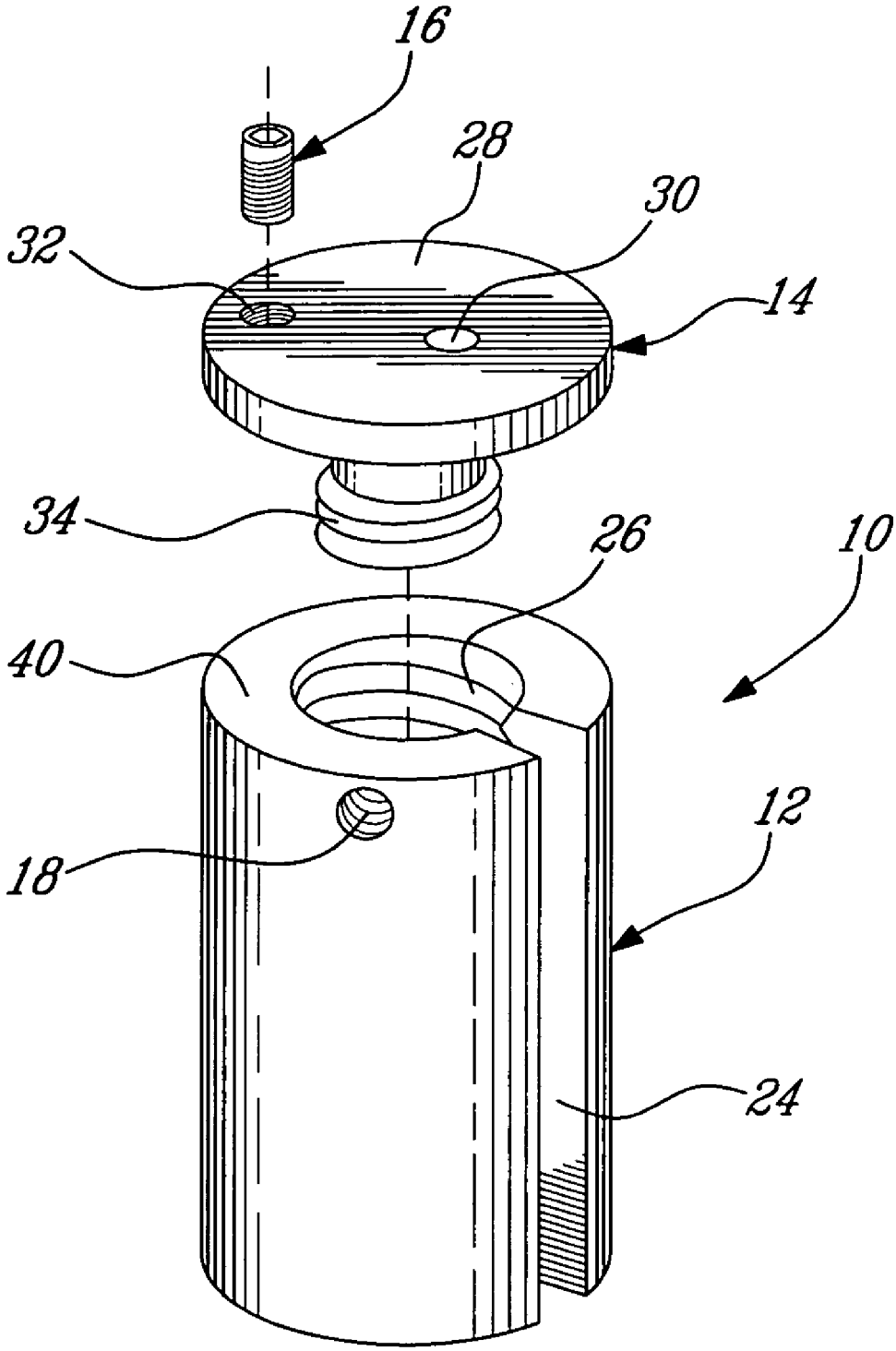
FIG. 1 is an exploded perspective view of an assembly made in accordance with the present invention.
Figure 2:
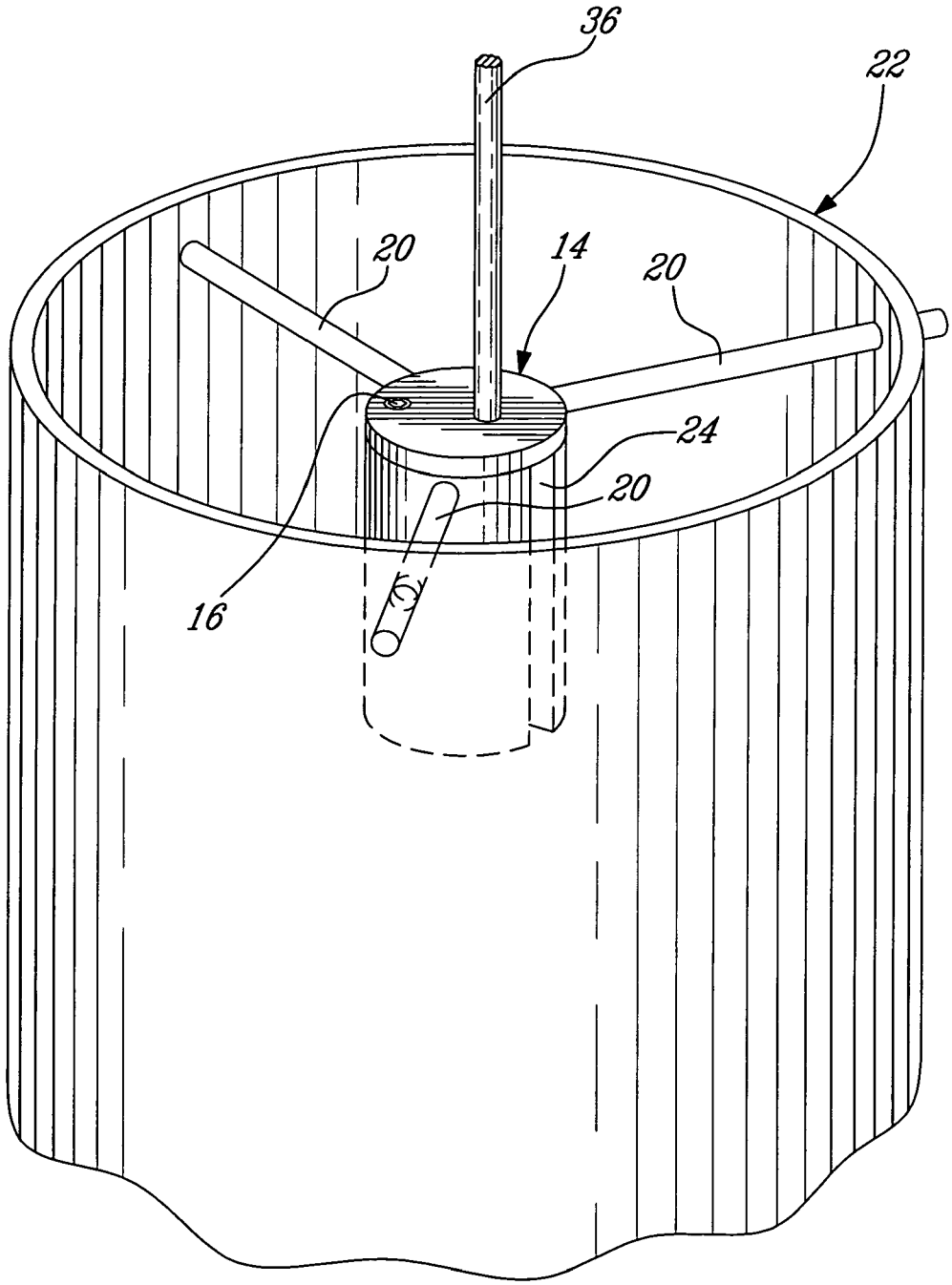
FIG. 2 is an enlarged perspective view of the assembly shown mounted to an upper part of a lamp-shade.

Referring to FIG. 1, there is shown an assembly, generally denoted 10, which consist of a socket member 12, a swivel cap 14 and a securing element 16 in the form of a set screw As further illustrated in FIG. 2, the socket member 12 is provided with a series of holes 18 (only one being shown) to receive a series of rod 20 (three being shown) each having one end received in the hole 18 and the opposite end engaging a corresponding hole extending through the upper part of a lamp-shade 22.

The socket member 12 is cylindrical in shape and displays a vertical slit 24 and a threaded inner portion 26 at its upper end, the function of which will be described further hereinbelow.

The swivel cap 14 has a disk shape top face 28 displaying a pair of holes 30 and 32 and a threaded lower extension 34 adapted to engage the threaded inner portion 26 of the socket member.

Figure 3:
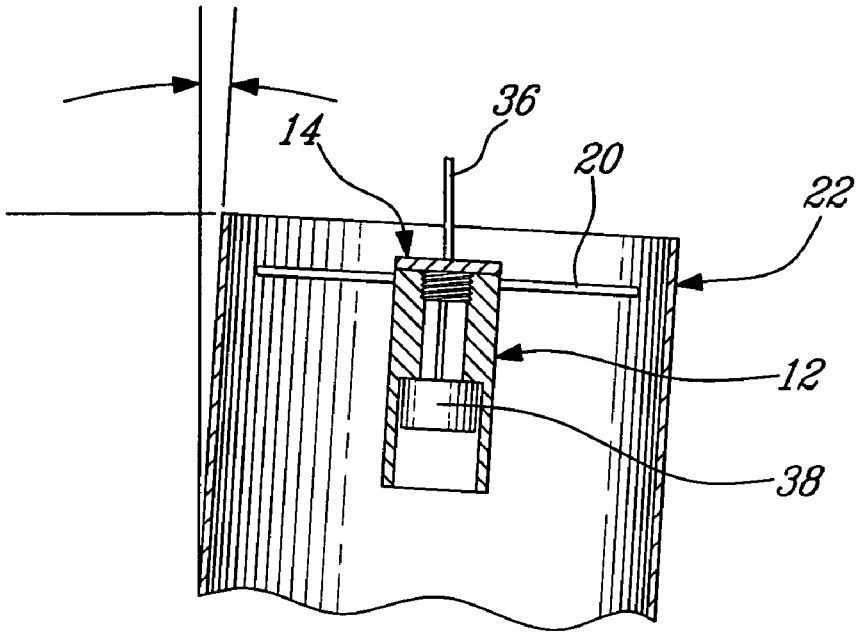
FIG. 3 is a partial cross-sectional view showing a lamp-shade in a non vertical position.
Figure 4:
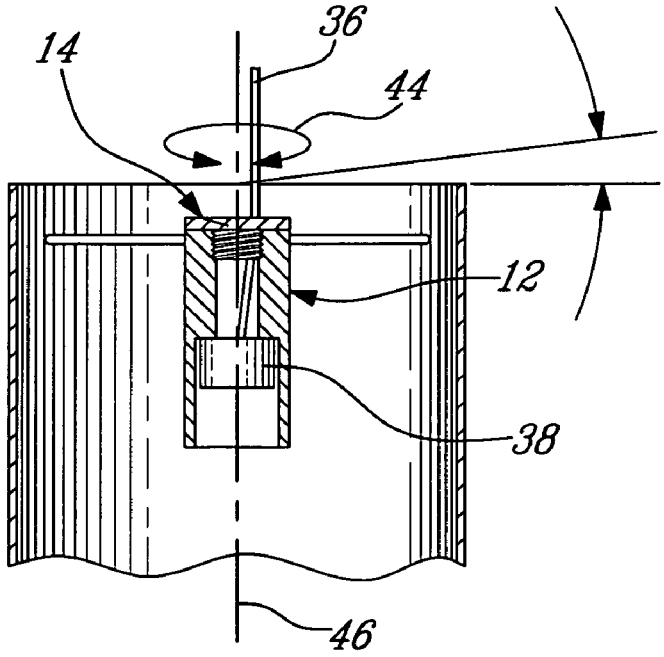
FIG. 4 is a partial cross-sectional view of the lamp-shade shown in a vertical position after using the assembly of the present invention.

In accordance with the present invention, the hole 30 is off-set with respect to the center of the disk shaped top face 28 and has a size adapted to allow passage of a cable 36, the lower end of which displays a light socket 38 (see FIGS. 3 and 4).

Hole 32 is located adjacent the peripheral edge of the top face 28 and is in vertical alignment with the annular top face 40 of the socket member 12. Hole 32 is threaded in order to enable the engagement of the threaded set screw 16, the lower end of which is adapted to contact the top face 40 of the socket member.

FIG. 3 illustrates the lamp-shade 22 in a non-vertical position.

To achieve the verticality of the lamp-shade (such as illustrated in FIG. 4), the swivel cap 14 is rotated, as indicated by the arrow 44, until the lamp-shade is moved until its axis 46 is parallel to the vertical axis of the cable 36. Thereafter, the set screw is rotated to contact the top face 40 of the socket member thereby maintaining the obtained verticality between the socket member and the swivel cap.

Although the invention has been described above with respect to one specific form, it will be evident to a person skilled in the art that it may be modified and refined in various ways. It is therefore wished to have it understood that the present invention should not be limited in scope, except by the terms of the following claims.

What is claimed is:

1. An assembly for vertically positioning a lamp-shade suspended by a cable having a lamp socket fixed at one end thereof, said assembly comprising:

a socket member having an open lower end for receiving said socket therein and an opened upper end;

a swivel cap adapted to engage the upper open end of said member; said swivel cap having an off-center hole to receive therethrough said cable; said cap being manually swivelable until said socket member has reached a vertical position; and means for securing said cap and said socket member to one another when said vertical position is reached.

2. An assembly as defined in claim 1, wherein said securing means consists of a set screw extending through said cap and having one end contacting an upper face of said socket member.

3. An assembly as defined in claim 1, wherein said cap has a threaded portion engageable with a threaded portion in said upper end of said socket member.

4. An assembly as defined in claim 1, wherein said socket member has a longitudinal slit to enable insertion of said cable therein.

5. An assembly as defined in claim 1, wherein said socket member is defined by a cylindrical body.

* * * * *